US006382052B1

(12) United States Patent
Chen

(10) Patent No.: US 6,382,052 B1
(45) Date of Patent: May 7, 2002

(54) RATCHET TOOL

(76) Inventor: Shwu Ruu Chen, 1, Alley 16, Lane 40, Jinn Te Road, Taichung (TW)

( * ) Notice: Subject to any disclaimer, the term of this patent is extended or adjusted under 35 U.S.C. 154(b) by 0 days.

(21) Appl. No.: 09/825,214

(22) Filed: Apr. 2, 2001

(51) Int. Cl.[7] ..... B25B 13/46
(52) U.S. Cl. ..... 81/63; 81/63.2
(58) Field of Search ..... 81/60–63.2

(56) References Cited

U.S. PATENT DOCUMENTS 5,957,009 A * 9/1999 McCann ..... 81/63.2
6,044,730 A * 4/2000 Roberts et al. ..... 81/63
6,230,591 B1 * 5/2001 Ling et al. ..... 81/63
6,260,448 B1 * 7/2001 Chaconas ..... 81/63
6,260,449 B1 * 7/2001 I-He ..... 81/63.2
6,282,993 B1 * 9/2001 Forman et al. ..... 81/63.2

* cited by examiner

*Primary Examiner*—Joseph J. Hail, III
*Assistant Examiner*—David B Thomas
(74) *Attorney, Agent, or Firm*—Pro-Techtor International Services

(57) ABSTRACT

A ratchet tool includes a ring-shaped head in which a toothed member is rotatably received and a pawl is received in a recess in the head and engaged with the toothed member. A chamber is defined beside the ring-shaped head and a control member is received in the chamber. The control member has a protrusion which is engaged with the notch of the pawl. A curved slot is defined through the control member and a shifting lever is connected to the control member. A torsion spring has a leg thereof fixedly connected to the control member and the other leg of the torsion spring is located in the curved slot.

1 Claim, 4 Drawing Sheets

RATCHET TOOL

FIELD OF THE INVENTION

The present invention relates to a ratchet tool that has a control member engaged with the pawl and a torsion spring 34 is engaged with the control member.

BACKGROUND OF THE INVENTION

A conventional ratchet tool is shown in FIG. 1 and generally includes a ring-shaped head 40 and a toothed member 42 rotatably received in the ring-shaped head 40. A pawl 41 has a toothed surface engaged with the toothed member 42 and a spring 43 is connected between the pawl 41 and a control member 44. The control member 44 is rotated by the user to engage one of two ends of the pawl 41 with the toothed member 42. Each of the two ends of the pawl 41 allows the pawl 41 to rotate a with the toothed member 42 or to move over the toothed member 42. The spring 43 tends to reach its fatigue limit after a period of time of use. Besides, the direction of change for the ratchet mechanism often fails because the control member 44 cannot be rotated to a proper position.

The present invention intends to provide a ratchet tool that has a simple structure and is able to properly position the pawl member to perform desired functions.

SUMMARY OF THE INVENTION

In accordance with one aspect of the present invention, there is provided a ratchet tool and comprising a shank and a ring-shaped head which has a toothed member rotatably received therein. A recess is defined in an inner periphery of the ring-shaped head and a pawl is received in the recess. The pawl has teeth in a front surface thereof so as to be engaged with the toothed member, and a spring biases a rear surface of the pawl. A chamber is defined beside the ring-shaped head and communicates with the recess. A control member is received in the chamber and has a protrusion which is engaged with a notch in a top of the pawl. A curved slot is defined through the control member and a shifting lever is connected to the control member. A torsion spring has a leg fixedly connected to a hole in the control member and the other leg of the torsion spring is located in the curved slot.

The primary object of the present invention is to provide a ratchet tool that has a flat control member and a torsion spring to achieve the ratchet purpose.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
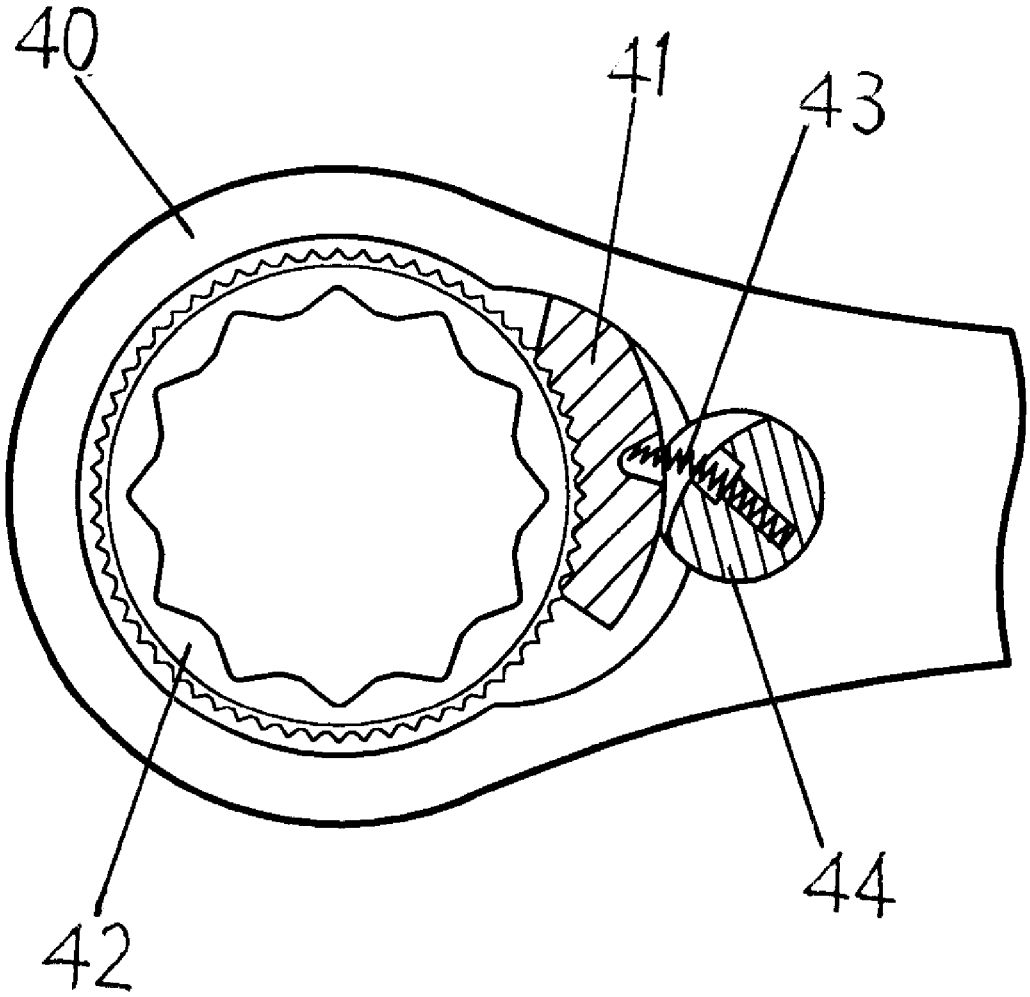
FIG. 1 PRIOR ART
FIG. 1 is cross sectional view to show a conventional ratchet tool.
Figure 2:
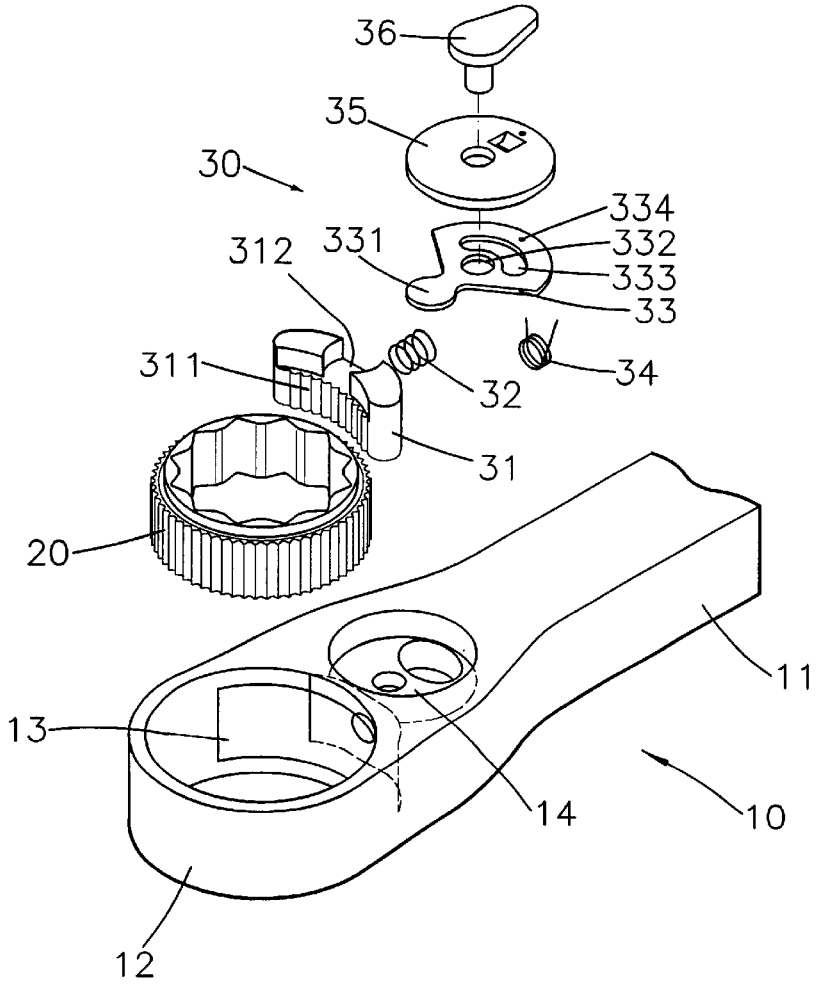
FIG. 2 is an exploded view to show a ratchet tool of the present invention.
Figure 3:
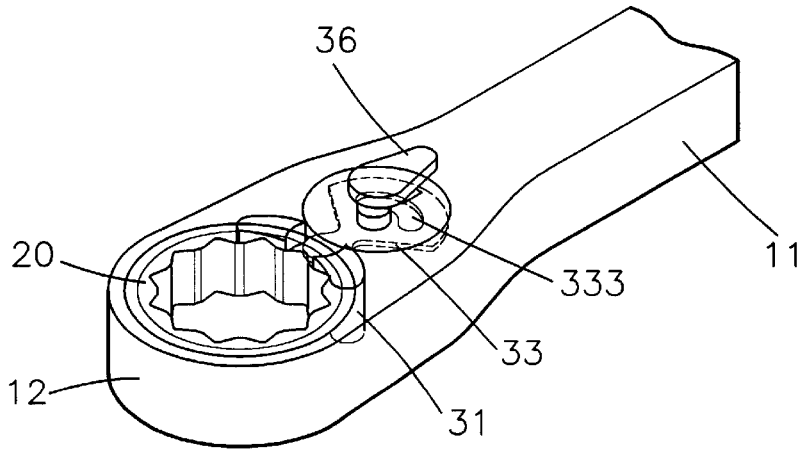
FIG. 3 is a perspective view to show the ratchet tool of the present invention.
Figure 4:
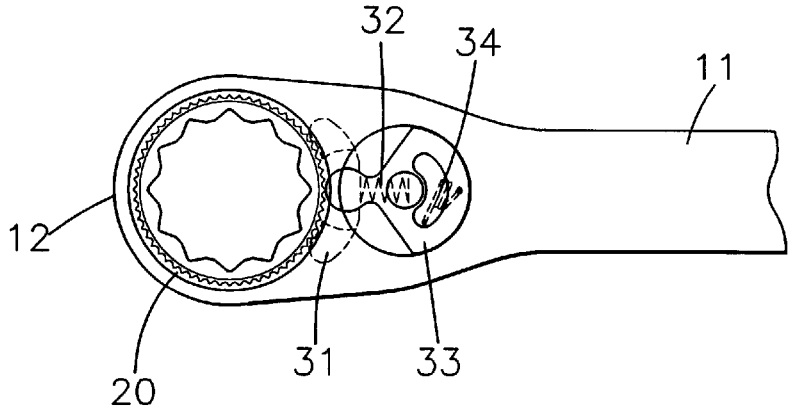
FIG. 4 is a top view to show the pawl of the ratchet tool of the present invention is in its neutral position.

Referring to FIGS. 2 to 4, the ratchet tool 10 of the present invention comprises a shank 11 and a ring-shaped head 12 which has a toothed member 20 rotatably received therein. A recess 13 is defined in an inner periphery of the ring-shaped head 12 and a pawl 31 is received in the recess 13. The pawl 31 has teeth 311 in a front surface thereof so as to be engaged with the toothed member 20 and a spring 32 biases a rear surface of the pawl 31 to push the pawl 31 toward the toothed member 20. A chamber 14 is defined beside the ring-shaped head 12 and communicates with the recess 13. A control means 30 is received in the chamber 14 and includes a control member 33 received in the chamber 14. The control member 33 has a protrusion 331 which is engaged with a notch 312 defined in a top of the pawl 31. A curved slot 333 is defined through the control member 33 and central hole 332 is defined through the control member 33. A shifting lever 36 has a insertion which is connected to the central hole 332 in the control member 33. A cap 35 seals the chamber 14 and located between the shifting lever 36 and the control member 33.

A torsion spring 34 has a leg fixedly connected to a hole 334 in the control member 33 and the other leg of the torsion spring 34 is located in the curved slot 333.

Figure 5:
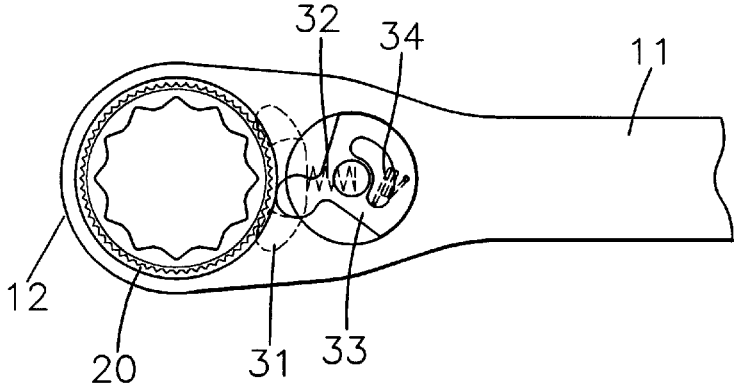
FIG. 5 is a top view to show the pawl of the ratchet tool of the present invention is shifted to one direction.
Figure 6:
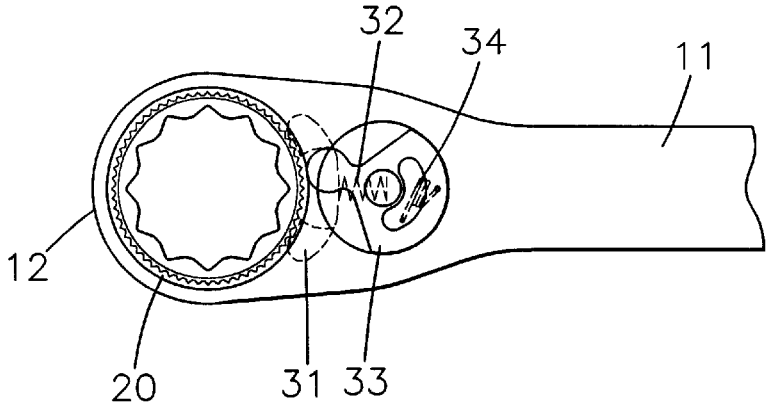
FIG. 6 is a top view to show the pawl of the ratchet tool of the present invention is shifted to the other direction.

Referring to FIG. 5, when pivoting the shifting lever 36, the control member 33 is rotated about the insertion of the shifting lever 36 so that the protrusion 331 pushes the pawl 31 to let the teeth 311 on one end of the pawl 31 be engaged with the toothed member 20. As shown in FIG. 6 when shifting the shifting lever 36 to the other direction, the pawl 31 is pivoted to let the teeth 311 on the other end of the pawl 31 be engaged with the toothed member 20.

Figure 7:
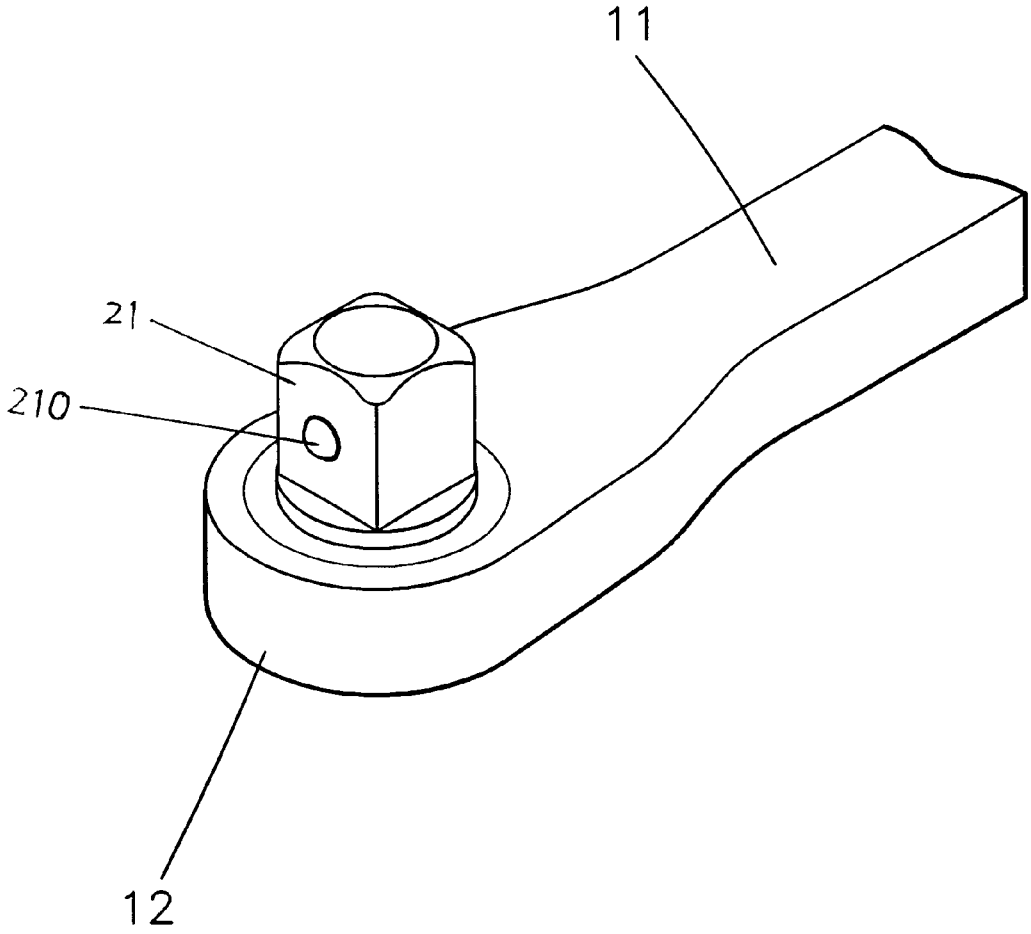
FIG. 7 is a perspective view to show another embodiment of the ratchet tool of the present invention.

FIG. 7 shows that the toothed member 20 has a shank 21 extending therefrom and a ball 210 is embedded in the shank 21 so as to secure a socket mounted on the shank 21.

While we have shown and described various embodiments in accordance with the present invention, it should be clear to those skilled in the art that further embodiments may be made without departing from the scope and spirit of the present invention.

What is claimed is:

1. A ratchet tool comprising:

a shank and a ring-shaped head which has a toothed member rotatably received in said ring-shaped head, a recess defined in an inner periphery of said ring-shaped head and a pawl received in said recess, said pawl having teeth in a front surface thereof so as to be engaged with said toothed member, a chamber defined beside said ring-shaped head and communicating with said recess, said pawl having a notch defined in a top thereof, a spring biasing a rear surface of said pawl;

a control member received in said chamber and having a protrusion which is engaged with said notch of said pawl, a curved slot defined through said control member and a shifting lever connected to a central hole in said control member, and a torsion spring having a leg fixedly connected to a hole in said control member and the other leg of said torsion spring located in said curved slot.

* * * * *